United States Patent [19]

Citron

[11] Patent Number: 4,729,511

[45] Date of Patent: Mar. 8, 1988

[54] POP-UP SPRINKLER

[75] Inventor: Manning Citron, San Marino, Calif.

[73] Assignee: James Hardie Irrigation, Inc., El Cajon, Calif.

[21] Appl. No.: 57,792

[22] Filed: Jun. 3, 1987

[51] Int. Cl.[4] ..... B05B 15/10

[52] U.S. Cl. ..... 239/205; 239/580; 239/581.2

[58] Field of Search ..... 239/203–206, 239/578, 580, 581.1, 581.2, 582.1

[56] References Cited

U.S. PATENT DOCUMENTS

| | | | |
|---|---|---|---|
| 1,931,761 | 8/1931 | Hertel | 299/61 |
| 2,086,281 | 7/1937 | Nelson et al. | 299/64 |
| 2,360,203 | 10/1944 | Cox | 299/61 |
| 3,323,725 | 6/1967 | Hruby, Jr. | 239/205 |
| 3,383,047 | 5/1968 | Hauser | 239/206 |
| 3,521,822 | 7/1970 | Friedmann et al. | 239/206 |
| 3,645,451 | 2/1972 | Hauser | 239/206 |
| 3,785,565 | 1/1974 | Perry et al. | 239/206 |
| 3,940,066 | 2/1976 | Hunter | 239/204 |
| 4,394,969 | 7/1983 | Jette | 239/578 |
| 4,402,438 | 9/1983 | Gregory | 239/578 |

*Primary Examiner*—Andres Kashnikow

*Assistant Examiner*—Michael J. Forman

*Attorney, Agent, or Firm*—Loyal M. Hanson; Gordon L. Peterson

[57] ABSTRACT

A sprinkler includes a housing with an inlet port through which to supply a flow of liquid to the housing interior and a stem disposed at least partially within the interior of the housing for movement between a retracted position and an extended position. A piston disposed within the interior of the housing responds to the flow of liquid to move the stem from the retracted position to the extended position. The stem defines a passageway extending from a lower portion of the stem to an upper portion of the stem, and the lower portion of the stem defines an opening through which the flow of liquid can pass from the interior of the housing into the passageway. A valve element moveably mounted on the stem at least partially blocks the opening, and a shaft rotatably mounted on the housing extends to a position outside of the interior of the housing. The shaft is coupled to the valve element so that the valve can be rotated by rotation of the shaft for purposes of restricting the flow of liquid through the opening a selected amount.

15 Claims, 5 Drawing Figures

10
11
12
14
15
16
17
18
19
20
21
22
23
24
25
26
27
28
29
30
31
32
33
34
35
36
38
41
42
44
50
51
65
70
71

10
11
12
14
16
17
18
19
20
21
22
23
24
25
26
27
28
29
30
31
32
34
35
36
37
38
41
42
44
50
51
52
60
65
70
71

POP-UP SPRINKLER

BACKGROUND OF THE INVENTION

1. Technical Field

This invention relates generally to irrigation equipment and the like, and more particularly to a sprinkler featuring a new and improved externally adjustable valve.

2. Background Information

Sprinklers often include a manually operated valve for purposes of adjusting the flow rate. The valve is disposed within the sprinkler housing and operated by manipulation of an adjustment mechanism accessible from the exterior of the housing. With this arrangement, the valve can be conveniently adjusted after the sprinkler is installed to achieve a desired sprinkling flow rate.

However, existing external adjustment mechanisms for this purpose have certain drawbacks that need to be overcome. For example, U.S. Pat. No. 3,323,725 to Hruby, Jr. describes a sprinkler having a stem on a piston within a housing. Water flowing into the housing applies force to the piston to cause the stem to pop up, and then flows through the stem and out of the sprinkler head. An externally adjustable valve arrangement is provided that restricts the flow into the housing to thereby regulate the flow to the stem, and this regulates the flow through the stem out of the sprinkler head.

Although effective in many respects, the valve arrangement described in the Hruby patent affects action of the water against the piston. In other words, the valve impedes the flow to the piston so that upward movement of the stem may be sluggish. Consequently, it is desirable to have an improved externally adjustable valve that regulates water flow without degrading stem movement.

U.S. Pat. No. 2,086,281 to Nelson et al. describes a sprinkler defining separate water passageways into the housing. A first one carries water to push the stem upwardly, and a second provides a path into the stem above the piston. Flow rate is adjusted by an externally adjustable valve that restricts water flow through the second passageway to adjust the flow rate out of the sprinkler head. Although the flow of water to the piston is unimpeded, a relatively complex arrangement is required. Consequently, it is desirable to have an externally adjustable valve that overcomes this concern also.

U.S. Pat. No. 3,940,066 to Hunter describes a sprinkler that employs a valve element in the form of a collar on the stem above the piston. Twisting the stem varies alignment of orifices in the collar and the stem to regulate flow into the stem. Thus, the flow to the piston is unimpeded. However, the stem must be twisted just the right amount, often just several degrees over the entire adjustment range. This demands careful attention and manual dexterity, and the problem is compounded when the stem is wet and more difficult to grasp. In addition, the stem is easily twisted out of a desired position by inadvertent contact as well as by such occurrences as a curious child manipulating the stem. Consequently, it is desirable to have an externally adjustable valve that overcomes these concerns as well.

SUMMARY OF THE INVENTION

This invention recognizes the problems associated with the prior art and provides a new and improved pop-up sprinkler having an externally adjustable valve with the desired attributes.

Briefly, the above and further objects of the present invention are realized by providing a conveniently and inexpensively fabricated sprinkler apparatus having a valve element that is driven with an externally-operated splined drive shaft to achieve more convenient, controlled valve adjustment while inhibiting undesired misadjustment. With this construction, regulation does not degrade stem movement and adjustment does not require manipulation of a wet stem. The drive shaft and valve may use gear reduction that makes fine adjustments more convenient, and inadvertent misadjustment less likely.

Generally, the apparatus includes a housing defining a hollow interior and an inlet port through which to supply a flow of liquid to the interior. A stem is disposed at least partially within the interior of the housing so that the stem can be moved between a retracted position and an extended position, and a piston disposed within the interior of the housing responds to the flow of liquid to move the stem.

The stem defines a passageway extending from a lower portion of the stem to an upper portion of the stem. The passageway can be connected in a conventional manner to a sprinkler head. The lower portion of the stem defines an opening through which the flow of liquid can pass from the interior of the housing into the passageway for passage to the sprinkler head, and a valve element moveably mounted on the stem at least partially blocks the opening. In one form of the invention, the valve element takes the form of a cylindrically-shaped collar disposed over the stem so that it can be rotated relative to the stem to various alignments of an orifice in the collar and the opening in the stem.

A shaft rotatably mounted on the housing extends to a position outside of the interior of the housing, and it is coupled to the valve element so that the valve can be rotated by rotation of the shaft for purposes of restricting the flow of liquid through the opening a selected amount. According to one aspect of the invention, the valve element includes gear teeth which engage splines on the shaft for this purpose. In addition to gear reduction, this arrangement maintains coupling as the stem moves to the extended position, and this is done with easily fabricated and relatively inexpensive components. Thus, the sprinkler apparatus of this invention overcomes many drawbacks of existing sprinklers with a new and improved externally adjustable valve.

The above mentioned and other objects and features of this invention and the manner of attaining them will become apparent, and the invention itself will be best understood, by reference to the following description taken in conjunction with the accompanying illustrative drawings.

DESCRIPTION OF THE PREFERRED EMBODIMENTS

Figure 1:
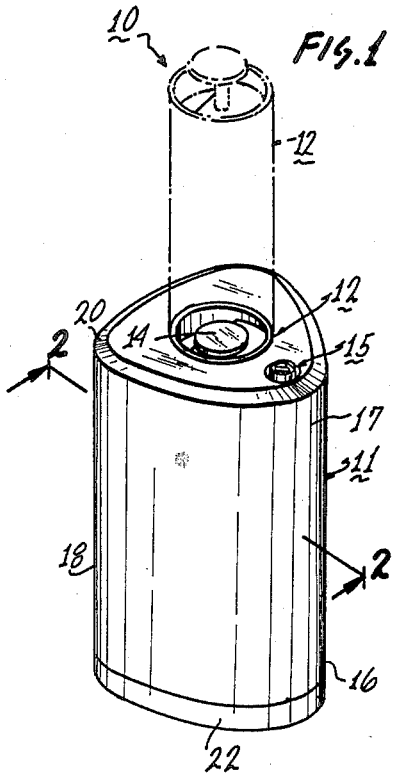
FIG. 1 is a perspective view of a sprinkler apparatus construction according to the invention showing the stem in a retracted position in solid lines and an extended position in phantom lines.

Referring now to FIG. 1, there is shown a new and improved pop-up sprinkler or apparatus 10 constructed according to the invention. Generally, the apparatus 10 includes a housing 11 on which is mounted a stem 12 that can be moved between a retracted position as shown in solid lines and an extended position as indicated in phantom lines. A flow of liquid, such as water, is supplied to the housing, and the pressure of the flow of liquid causes the stem 12 to move to the extended position, with the liquid discharging from the sprinkler head 14. Rotation of a shaft 15 restricts the flow of liquid through the stem 12, and this enables adjustment of the sprinkling rate at which the liquid is discharged from the sprinkler head 14.

Typically, a lower portion 16 of the housing 11 is buried within the earth so that an upper portion 17 is generally flush with the surface of the earth. The stem 12 assumes the retracted position until the flow of liquid is supplied to the apparatus 10, and then the stem 12 pops up to the extended position to discharge the liquid in a desired sprinkling pattern.

Considering first the housing 11, it includes a shell 18 defining a hollow interior 19 extending from the bottom portion 16 of the housing 11 to the upper portion 17 of the housing 11. An upper cap 20 attached to the shell 18 by suitable means such as sonic welding encloses the interior 19 while defining an opening 21 through which the stem 12 extends. The upper cap 20 also provides a bearing arrangement for the shaft 15 as subsequently discussed.

The housing 11 includes a lower cap 22 attached by suitable means to the case 11 across the bottom portion 16 of the housing 11. The lower cap 22 defines an inlet port 23 through which to pass a flow of water into the interior 19. A connector portion 24 of the lower cap 22 is adapted to receive a threaded line supplying the flow of water.

Preferably, the housing 11 is composed of a suitable thermoplastic material that provides rigidity and resistance to chemical deterioration when buried in the earth. It is injection molded according to known techniques, and the upper and lower caps are attached so that the housing 11 is generally fluid tight. As an idea of size, the illustrated casing 11 is approximately twelve to thirteen centimeters high between extremes of the upper cap 20 and lower cap 22, and approximately six to seven centimeters across. Of course, these dimensions may vary according to the specific application.

A flow of liquid is supplied to the inlet port 23 to the interior 19, and it flows through the stem 12 to be discharged from the sprinkler head 14, the stem 12 communicating the flow of liquid from the interior 19 to the sprinkler head 14. The stem 12 includes a tubular body 25 that defines a passageway 26 extending from a lower portion 27 of the body 25 to an upper portion 28 of the body 25 for this purpose. As a further idea of size, the illustrated stem 12 is approximately three centimeters in outside diameter and approximately ten to eleven centimeters long between the extremities of the lower portion 27 and the upper portion 28.

Figure 5:
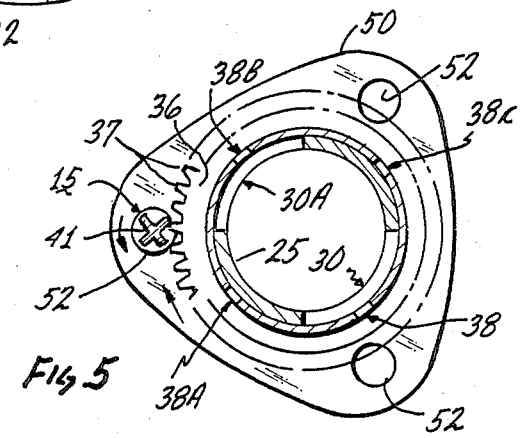
FIG. 5 is a transverse cross sectional view taken on line 5—5 of FIG. 4.

The sprinkler head 14 is mounted in fluid communication with the passageway 26 at the upper portion 28 of the body 25 by suitable means such as a threaded plug 29. The lower portion 27 defines at least one opening 30 (FIGS. 2–3) that extends through the lower portion 27. The flow of liquid passes from the interior 19 of the housing 11 through the opening 30 to the passageway 26 of the stem 12. Preferably, a second opening 30A is included in a position diametrically opposite the opening 30 (FIG. 5). The openings 30 and 30A are generally similar in size and shape, and therefore only the opening 30 is described in further detail.

The opening 30 is elongated circumferentially and extends circumferentially along the lower portion 27 of the stem 12 from a narrow region 31 to a broader region 32. Thus, the opening 30 transitions from the narrow region 31 to the broader region 32, and this feature combines with a valve element 33 disposed over the lower end portion 27 of the body 25 to enable adjustment of the rate of the flow of liquid into the passageway 26.

Figure 2:
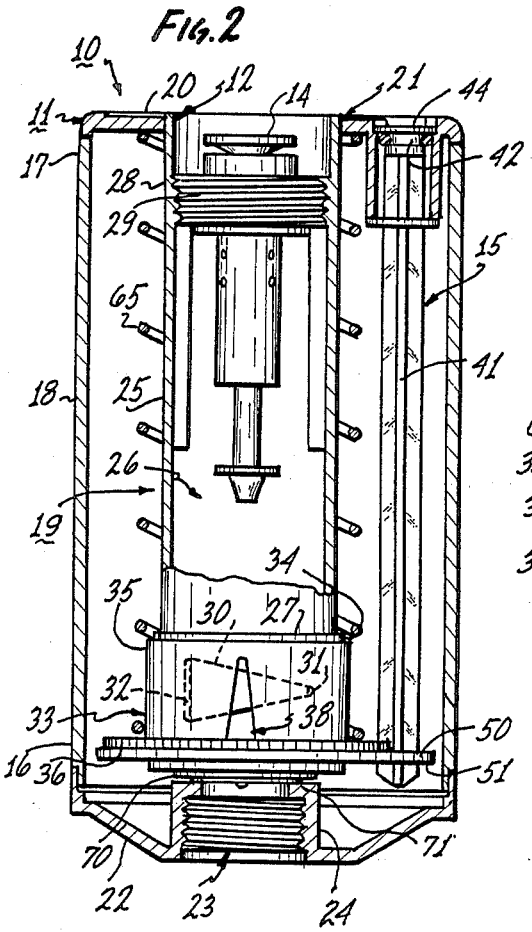
FIG. 2 is an enlarged cross sectional view of the apparatus taken on line 2—2 of FIG. 1 with the stem in the retracted position.
Figure 3:
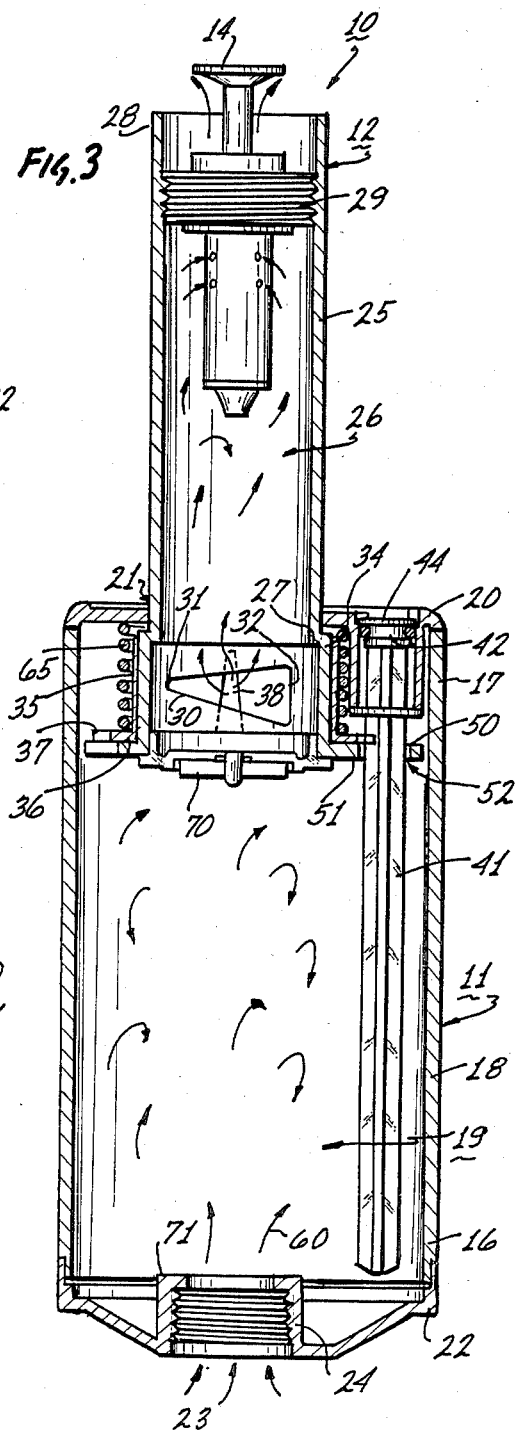
FIG. 3 is an enlarged cross sectional view similar to FIG. 2 with the stem in the extended position.

The lower portion 27 of the body 25 defines a cylindrically-shaped exterior surface 34 (FIGS. 2–3). The valve element 33 is in the form of a collar 35 disposed generally concentrically over the exterior surface 34 so that the collar 35 can be rotated relative to the stem 12 with the exterior surface 34 providing a bearing surface for this purpose. The valve element 33 includes a flange 36 attached to the collar 35 that defines a plurality of gear teeth 37. The gear teeth engage the shaft 15 as subsequently described so that rotation of the shaft 15 causes corresponding rotation of the valve element 33 relative to the stem 12. In the illustrated apparatus 10, the valve element 33 is of unitary thermoplastic construction so that the flange 36 is integrally attached to the collar 35.

The collar 35 defines at least one orifice 38 in the form of a longitudinally-extending slot, i.e. elongated along a path generally parallel to the axis of rotation of the collar 35. As the collar 35 is rotated relative to the stem 12, the orifice 38 overlaps different regions of the opening 30. Thus, the amount of overlap varies as the collar 35 is rotated to move the orifice 38 from the narrow region 31 to the broader region 32 of the opening 30. In this way, rotation of the collar 35 varies the amount by which the flow of fluid is restricted from passing from the interior 19 of the housing 11 to the passageway 26 of the stem 12.

Preferably, three additional orifices 38A through 38C are included (FIG. 5) at evenly spaced locations on the collar 35. Thus, as the collar 35 is rotated sufficiently so that one of the orifices 38 and 38A through 38C passes beyond the opening 30, the next orifice overlaps the opening 30. This arrangement provides continuous adjustability by rotation in one direction. First one orifice crosses the opening, and then another as the valve element 33 is rotated.

The apparatus 10 includes coupling means for coupling the shaft to the valve element so that the valve can be moved by rotation of the shaft for purposes of restricting the flow of liquid through the opening a selected amount. This is accomplished in the apparatus 10 by a plurality of longitudinally extending splines 41 on the shaft 15 that engage the gear teeth 37. Thus, rotation of the shaft 15 causes the collar 35 to rotate.

The shaft 15 includes an upper end portion 42 that is rotatably mounted on the upper cap 20 to enable rotational movement of the shaft 15 by manual engagement of a slot 43 in a head 44 of the shaft 15. Thus, by the insertion of a suitable tool, such as a screwdriver blade or key, for example, one can rotate the shaft 15 to cause the collar 35 to rotate and thereby adjust the amount of overlap of the orifice 38 and the opening 30. This arrangement provides a degree of security against inadvertent or purposeful misadjustment. In addition, the combination of the shaft 15 and the teeth 37 provides a reduction in rate of rotation that facilitates fine adjustment of the flow of liquid.

The apparatus 10 includes a piston 50 disposed within the interior 19 of the housing 18 for responding to the flow of liquid to cause the stem 12 to move from the retracted position to the extended position. Of course, this can be accomplished with different piston arrangements, but the illustrated apparatus 10 utilizes a stem-and-piston combination of unitary thermoplastic construction so that the piston portion 50 is integrally attached to the lower portion 27 of the stem 12.

The piston 50 is disposed downwardly from the opening 30, and it defines a piston face 51 against which the flow of water exerts pressure to move the stem 12. The piston portion 50 fits somewhat loosely within the interior 19 of the housing 11 so that the flow of liquid can pass between the piston 50 and the housing 11 to the orifice 38. The piston 50 has a shape which generally conforms to the non-circular cross sectional shape of the interior 19 in a plane generally perpendicular to the direction the stem 12 is moved by the flow of liquid. This serves to prevent rotation of the piston 50 and the stem 12 relative to the housing 11.

The piston 50 includes at least one shaft hole 52 extending through the piston 50 that receives the shaft 15. This retains the shaft 15 in desired proximity with the flange 36 of the valve element 33 so that the splines 41 are retained in engagement with the gear teeth 37. As the stem 12 is moved between the retracted position and the extended position, the flange 36 slides along the shaft 15 with the gear teeth 37 retained in desired engagement with the splines 41. Other coupling arrangements can be devised without departing from this inventive aspect, such as the inclusion of an idler gear between the shaft 15 and the gear teeth 36 or a gear slidably mounted on the shaft 15 that engages the gear teeth 37.

In operation, the apparatus 10 is buried as described above and operatively connected to a flow of liquid. The flow of liquid, depicted in FIG. 3 by arrows 60, exerts pressure against the face 51 of the piston 52, and this causes the stem 12 to pop up to the extended position. Some of the liquid flows between the piston 50 and the housing 11, through the orifice 38 and opening 30, and into the passageway 26 for subsequent discharge from the sprinkler head 14.

Figure 4:
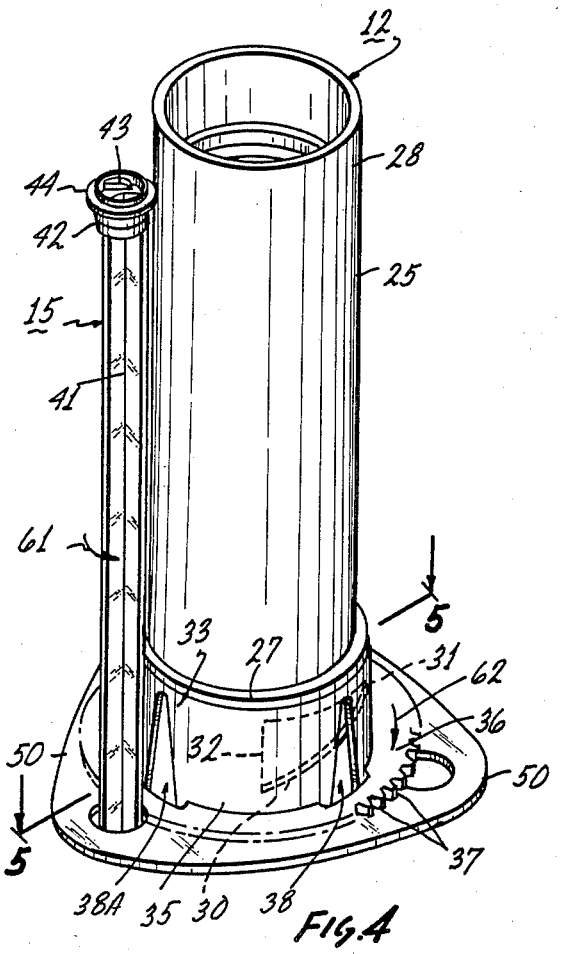
FIG. 4 is a perspective view of the stem and drive shaft apart from the housing.

In order to adjust the rate of flow, the shaft 15 is rotated manually, such as indicated by the arrow 61 in FIG. 4, and this causes the valve element 33 to rotate relative to the stem as indicated by the arrow 62. As the valve element 33 rotates, the orifice 38 in the collar 35 is moved so that it overlaps the opening 30 by a desired amount, and this restricts the flow of liquid to a desired rate. When the flow of liquid is turned off, the stem 12 returns to the retracted position under the influence of a spring 65 that supplements the pull of gravity to produce a positive return. When the stem 12 returns to the retracted position, a washer 70 mounted on the stem 12 enagages a valve seat 71 to close the inlet 23.

Thus, the apparatus 10 overcomes many drawbacks of existing sprinklers with a new and improved externally adjustable valve. Flow regulation does not degrade movement of the pop-up stem. Adjustment does not require manipulation of a wet stem. Gear reduction makes fine adjustments more convenient, and misadjustment is less likely.

Although an exemplary embodiment of the invention has been shown and described, many changes, modifications, and substitutions may be made by one having ordinary skill in the art without necessarily departing from the spirit and scope of this invention.

What is claimed is:

1. A sprinkler apparatus, comprising:

a housing defining a hollow interior and an inlet port through which to supply a flow of liquid to the interior;

a stem mounted on the housing to be moved between a retracted position and an extended position, the stem having a passageway and an opening through which the flow of liquid can pass from the interior of the housing to the passageway within the stem;

a piston mounted within the housing to respond to the flow of liquid and move the stem from the retracted position to the extended position;

a valve element mounted on the stem, which valve element is adapted to be moved relative to the stem to at least partially block the opening;

a shaft rotatably mounted on the housing; and coupling means for coupling the shaft to the valve element so that the valve can be moved by rotation of the shaft for purposes of restricting the flow of liquid through the opening a selected amount.

2. An apparatus as recited in claim 1, wherein:

the stem defines a cylindrically-shaped exterior surface; and the valve element includes a collar disposed generally concentrically over the cylindrically-shaped exterior surface, the collar defining an orifice adapted to be positioned in overlapping relationship with the opening in the stem by rotation of the collar relative to the stem.

3. An apparatus as recited in claim 2, wherein:

the collar includes a portion defining a plurality of gear teeth; and the shaft includes a plurality of splines adapted to engage the gear teeth for purposes of causing the collar to rotate relative to the stem when the shaft is rotated.

4. An apparatus as recited in claim 3, wherein:

the splines extend longitudinally along the shaft to maintain engagement with the gear teeth as the stem is moved between the retracted position and the extended position.

5. An apparatus as recited in claim 3, wherein:

the gear teeth and splines are adapted to provide a reduction in the rate of rotation of the collar relative to the rate of rotation of the shaft.

6. An apparatus as recited in claim 3, wherein:

the opening in the stem transitions circumferentially from a narrow region of the opening to a broader region of the opening; and the orifice in the collar is in the form of a longitudinally extending slot adapted to be positioned by rotation of the collar in overlapping relationship with a selected region of the opening to thereby adjust the amount by which the orifice overlaps the opening.

7. An apparatus as recited in claim 1, wherein:

the shaft extends within the interior of the housing to an upper end portion of the shaft that is disposed in a position accessible from outside of the interior of the housing to enable manual rotation of the shaft.

8. An apparatus as recited in claim 7, wherein:

the upper end portion of the shaft is rotatably mounted on an upper portion of the housing; and the upper end portion of the shaft includes a slotted head adapted to be manually engaged for purposes of rotating the shaft.

9. An apparatus as recited in claim 1, wherein:

the piston includes an integral portion of the stem.

10. An apparatus as recited in claim 1, wherein:

the piston is disposed between the inlet and the opening in the stem.

11. An apparatus as recited in claim 1, wherein:

the piston defines a piston face disposed downwardly from the opening in the stem.

12. An apparatus as recited in claim 11, wherein:

the piston fits loosely in the housing to enable passage of the flow of fluid between the piston and the housing to the opening in the stem.

13. An apparatus as recited in claim 1, wherein:

the piston defines a hole adapted to receive the shaft to retain the shaft in engagement with the valve element for coupling purposes as the stem moves between the retracted position and the extended position.

14. An apparatus as recited in claim 1, wherein:

the interior of the housing has a noncircular cross sectional shape;

and the piston has a shape conforming to the cross sectional shape of the interior to prevent rotation of the piston relative to the housing.

15. A sprinkler apparatus, comprising:

a housing defining a hollow interior extending from a lower portion of the housing to an upper portion of the housing and an inlet port through which to supply a flow of liquid to the interior;

a stem disposed at least partially within the interior of the housing, which stem is adapted to be moved between a retracted position in which the stem is disposed substantially within the interior of the housing and an extended position in which the stem extends beyond the upper portion of the housing;

an enlarged portion of the stem defining a piston adapted to respond to the flow of liquid supplied to the interior of the housing to move the stem from the retracted position to the extended position;

the stem defining a passageway extending from a lower portion of the stem to an upper portion of the stem;

the lower portion of the stem defining a cylindrically-shaped exterior surface on the stem and an opening extending through the cylindrically-shaped exterior surface to the passageway through which the flow of liquid can pass from the interior of the housing into the passageway;

a valve element in the form of a collar disposed generally concentrically over the cylindrically-shaped surface, which collar is adapted to be rotated relative to the stem and includes a portion defining a plurality of gear teeth to be used in rotating the collar;

the collar defining an orifice adapted to be positioned in overlapping relationship with the opening in the lower portion of the stem by rotation of the collar relative to the stem;

a shaft rotatably mounted on the housing, the shaft having a plurality of longitudinally-extending splines adapted to engage the gear teeth as the stem is moved between the retracted position and the extended position for purposes of causing the collar to rotate relative to the stem when the shaft is rotated, which shaft extends within the interior of the housing to an upper end portion of the shaft that is disposed in a position accessible from outside of the interior of the housing to enable manual rotation of the shaft.

* * * * *